US007552747B1

(12) United States Patent
Sargsyan

(10) Patent No.: US 7,552,747 B1
(45) Date of Patent: Jun. 30, 2009

(54) DUAL SWIVEL WATER SPOUT ASSEMBLY

(76) Inventor: Ararat Sargsyan, 1550 N. Hobart Blvd., Apt. 308, Los Angeles, CA (US) 90027

( * ) Notice: Subject to any disclaimer, the term of this patent is extended or adjusted under 35 U.S.C. 154(b) by 320 days.

(21) Appl. No.: 11/640,037

(22) Filed: Dec. 18, 2006

(51) Int. Cl.
*B67D 5/37* (2006.01)

(52) U.S. Cl. ..... 137/801; 4/601

(58) Field of Classification Search ..... 137/801, 137/615, 616, 616.7; 4/675–678, 567, 568, 4/570, 601
See application file for complete search history.

(56) References Cited

U.S. PATENT DOCUMENTS 560,749 A * 5/1896 Pearson ..... 137/616.5
1,075,483 A * 10/1913 Lindgren ..... 239/25
4,975,993 A * 12/1990 Black et al. ..... 4/601
6,070,612 A 6/2000 MacAusland
6,457,191 B2 10/2002 Brandebusemeyer

* cited by examiner

*Primary Examiner*—John Rivell
*Assistant Examiner*—Craig M Schneider
(74) *Attorney, Agent, or Firm*—J. E. McTaggart

(57) ABSTRACT

In a swivel water spout assembly, two spouts are arranged one above the other with the upper spout extending past the lower spout at the distal end region where each spout is configured with a downwardly-facing outlet, typically a nozzle with a strainer screen. Each spout is configured with a circular hub portion at the proximal end. The two hub portions are stacked one above the other, surrounding a tubular support sleeve connected to a supply of pressurized water. Each spout can swivel independently about the support sleeve to service two sink regions or two different items in a sink simultaneously.

5 Claims, 6 Drawing Sheets

DUAL SWIVEL WATER SPOUT ASSEMBLY

FIELD OF THE INVENTION

The present invention relates to the field of plumbing fixtures and more particularly to a dual swivel water spout assembly for providing two water streams at different locations simultaneously.

BACKGROUND OF THE INVENTION

In addition to single sinks equipped with one or two fixed water spouts, sinks with two side-by-side sink compartments are commonly equipped with a single swivel spout which can supply water to only one compartment at a time and which must be relocated manually between the two corresponding working locations each time it is desired to change the compartment receiving water. Even in a single compartment sink, it would often be beneficial to be able to direct tap water to two items in the sink simultaneously; however with the conventional single spout, even the swivel type, the water can only be directed to the two items sequentially, requiring twice the time that would be required if the water could be directed to the two items simultaneously.

DISCUSSION OF KNOWN ART

DUAL OUTLET FAUCET disclosed in U.S. Pat. No. 6,457,191 to Brandebusemeyer et al provides a single spout containing a pair of passageways receiving liquids from different sources and a corresponding pair of downwardly facing outlets, capable of joint rotation but not mutually independent rotation.

OBJECTS OF THE INVENTION

It is a primary object of the invention to provide a water spout assembly having two spouts that can be rotated about a common support sleeve independent of each other for convenient co-operation with a doubly-compartmented kitchen sink or laundry tub wherewith each spout can be positioned optimally for each corresponding compartment so that both compartments can receive water simultaneously.

It is a further object to provide alternative embodiments regarding the status of water passage as a function of the location of each swivel spout throughout its range of rotation.

SUMMARY OF THE INVENTION

In a preferred embodiment, two spouts are arranged one above the other with the upper spout extending past the lower spout. Each spout is configured at the outward end region with a downwardly-facing water outlet, typically a threadedly attached nozzle including a strainer screen, and with a circular hub portion at the opposite end, the two hub portions being stacked one above the other, surrounding a generally cylindrical support sleeve that provides a supply of water and that enables each spout to swivel independently.

These and other objects and advantages of the present invention will become apparent from the following more detailed description, taken in conjunction with the accompanying drawings which illustrate the invention, by way of example.

DETAILED DESCRIPTION OF THE INVENTION

Figure 1:
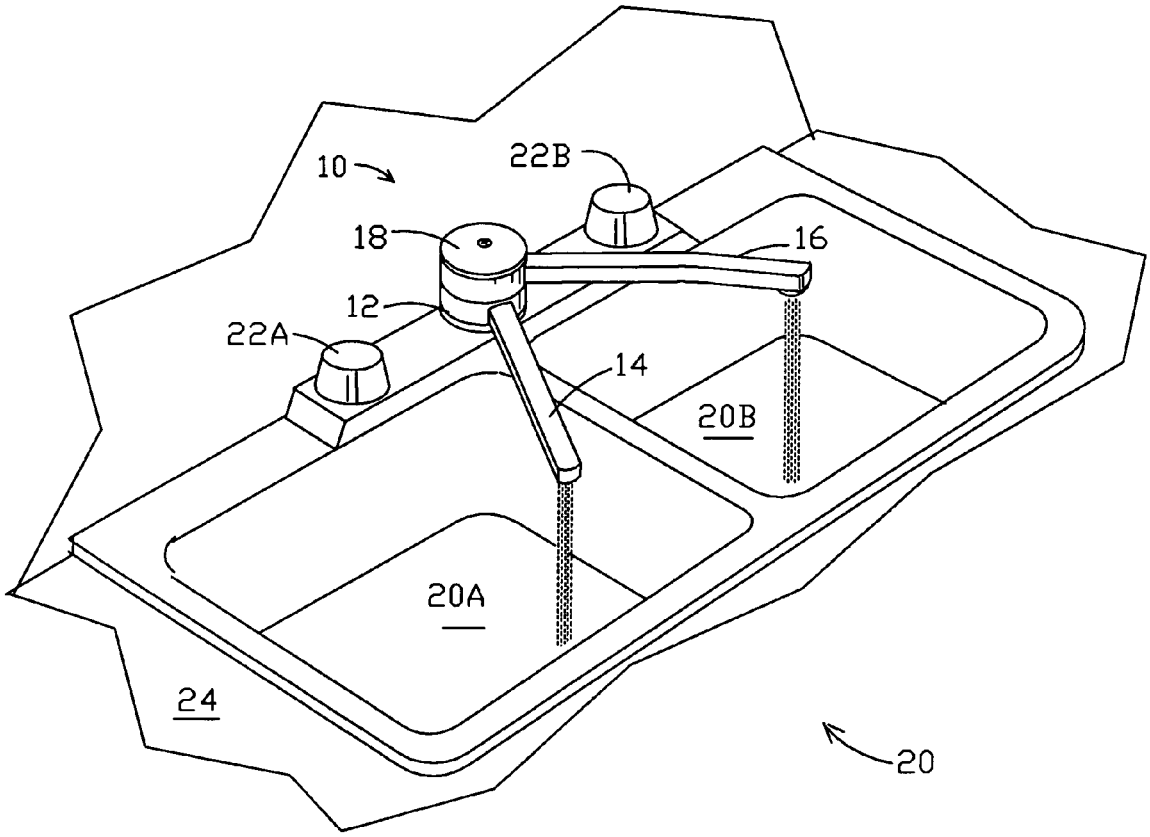
FIG. 1 is a perspective view of a dual compartment sink equipped with a dual swivel spout assembly representing a preferred embodiment of the present invention.

FIG. 1 shows a dual swivel spout assembly 10 of the present invention having a support sleeve of which flange 12A is visible, a lower spout 14, an upper spout 16 and a top cap 18. Spouts 14 and 16 are independently rotatable and are shown rotated to optimal locations above the corresponding compartments 20A and 20B of a sink 20 that is equipped with faucet handles 22A and 22B, typically cold and hot, and installed in a counter-top 24. When either or both faucet handles are turned on, water flows from both spouts as shown as long as the spouts are located non-parallel to each other.

Figure 2:
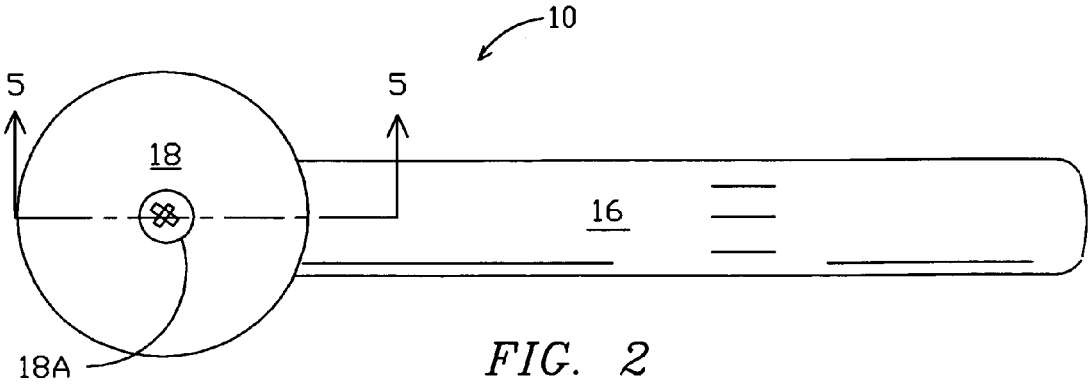
FIG. 2 is a top view of the water spout assembly of FIG. 1 with the two spouts in alignment.

FIG. 2 is a top view of the water spout assembly 10 of FIG. 1 with the two spouts in alignment so that only upper spout 16 is visible, along with a circular top cap 18 retained by a machine screw 18A.

Figure 3:
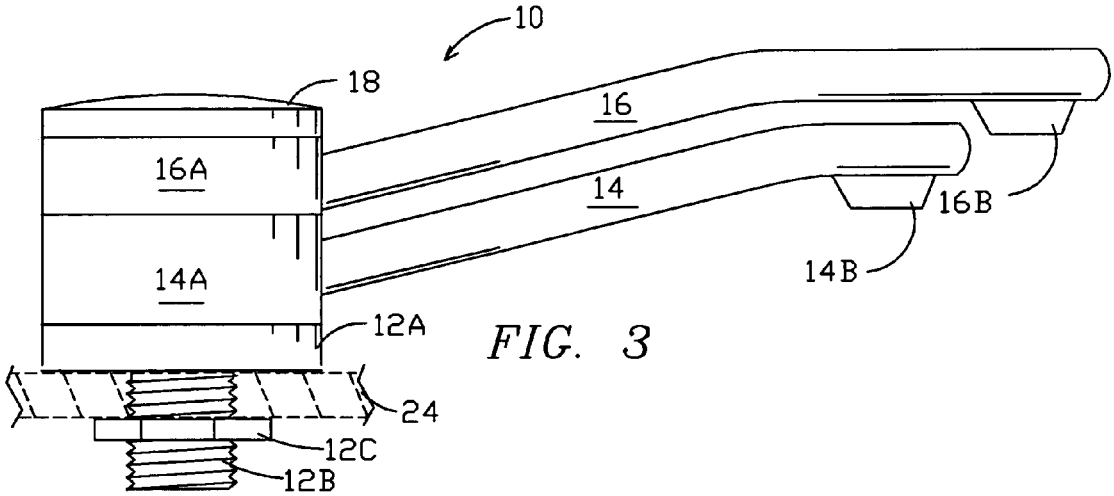
FIG. 3 is a side elevation view of the water spout assembly of FIGS. 1 and 2.

FIG. 3 is a side elevation view of the water spout assembly 10 of FIGS. 1 and 2 installed with the flange 12A held down onto a counter-top 24 (shown in broken lines) by the threaded lower end portion 12B of the support sleeve, secured in place by a hex nut 12C.

Stacked above flange 12A are the hub portion 14A of lower spout 14, the hub portion 16A of upper spout 16, and top cap 18. Spouts 14 and 16 as shown are rotated to be in alignment and are fitted with threadedly attached downward-facing strainer nozzles 14B and 16B.

Figure 4:
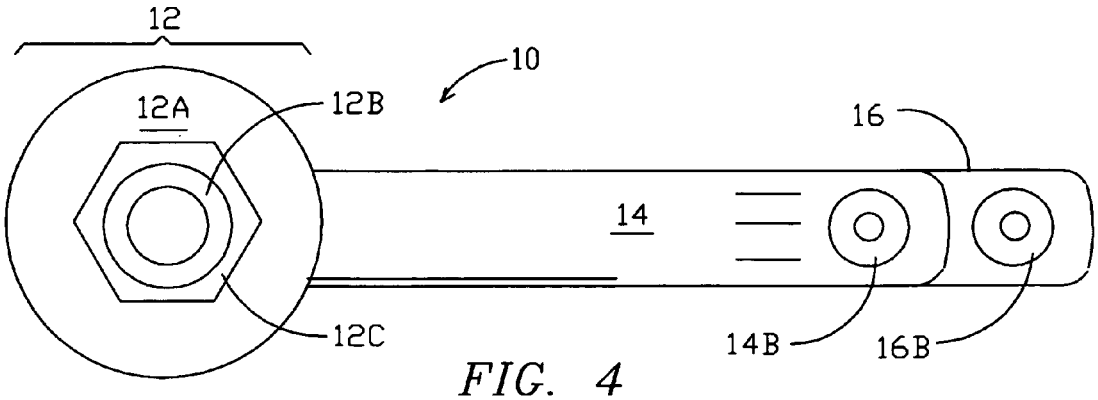
FIG. 4 is a bottom view of the water spout assembly of FIGS. 1-3.

FIG. 4 is a bottom view of the water spout assembly 10 of FIGS. 1-3 showing support sleeve 12 with its central water passageway in the threaded lower end portion 12B secured by nut 12C, the bottom side of spout 14 and the over-extending portion of spout 16, along with strainer nozzles 14B and 16B.

Figure 5:
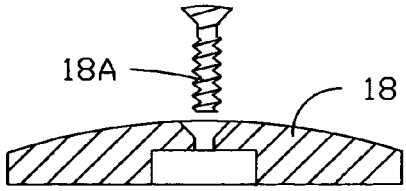
FIGS. 5-8 are cross-sections of the four components of the water spout assembly of FIGS. 1-4, taken in a vertical plane through axis 5-5 of FIG. 2.

FIG. 5 is a cross-section of the top cap 18 and its retaining machine screw 18A.

Figure 6:
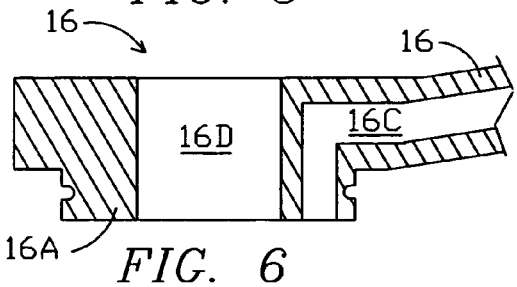

FIG. 6 is a cross-section of the hub portion 16A of upper spout 16, configured with a main central cylindrical bore 16D and a spout passageway 16C that exits downwardly at the bottom interface surface.

Figure 7:
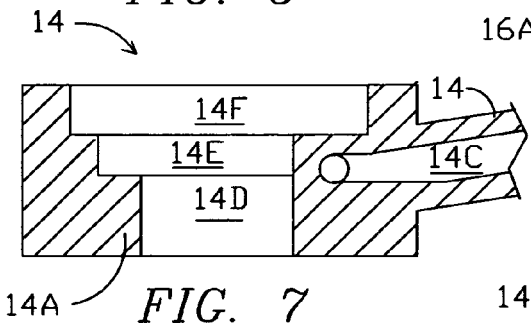

FIG. 7 is a cross-section of the hub portion 14A of lower spout 14, configured with a main central cylindrical bore 14D, an enlarged cavity region 14E and a further enlarged cavity region 14F dimensioned to provide a sliding fit around the lower stepped region of upper hub portion 16A.

Figure 8:
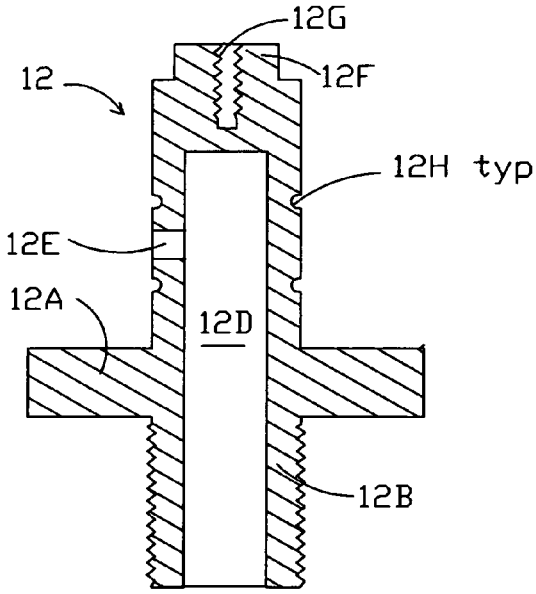

FIG. 8 is a cross-section the support sleeve 12 showing the lower end threaded portion 12B, mounting flange 12A, central water passageway 12D, a water aperture 12E through the wall, an upper cap attachment region 12F with threaded hole 12G, and two annular grooves 12H for O-ring seals. The cap attachment region 12F is typically made square to engage a mating square recess configured on the underside of top cap 18 (FIG. 5) to prevent the top cap 18 from loosening or rotating. Cap 18 is held in place by screw 18A engaging threaded hole 12G in support sleeve 12.

Figure 9:
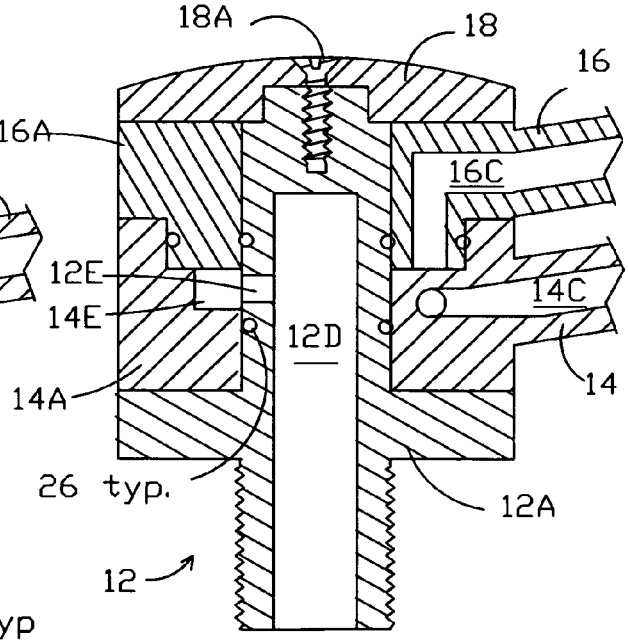
FIGS. 9 and 10 are cross-sections of the components of FIGS. 5-8 shown assembled together to form the water spout assembly of FIGS. 1-4.

FIG. 9 is a cross-section showing the four components of FIGS. 5-8 assembled together to form the water spout assembly of FIGS. 1-4. The cylindrical outside diameter of the main portion of support sleeve 12 above flange 12A is dimensioned to provide a sliding fit inside the bores of hub portions 14A and 16A as shown. Water-tightness at the three swiveling interfaces is provided by three sealing rings 26, typically neoprene O-rings, located at the three key locations shown. The sealing rings 26 are seated in machined annular grooves; two around support sleeve 12 and one around the lower region of hub portion 16A as shown.

Water entering passageway 12D, from the supply beneath, flows through aperture 12E into cavity 14E, which communicates with passageway 14C in the lower spout 14 to provide water flow from lower spout 14 regardless of its rotational position. However, whenever the two spouts 14 and 16 are aligned together as shown, there is no water flow from the upper spout 16 since its passageway 16C is blocked by the top surface of lower hub portion 14A, as shown.

Figure 10:
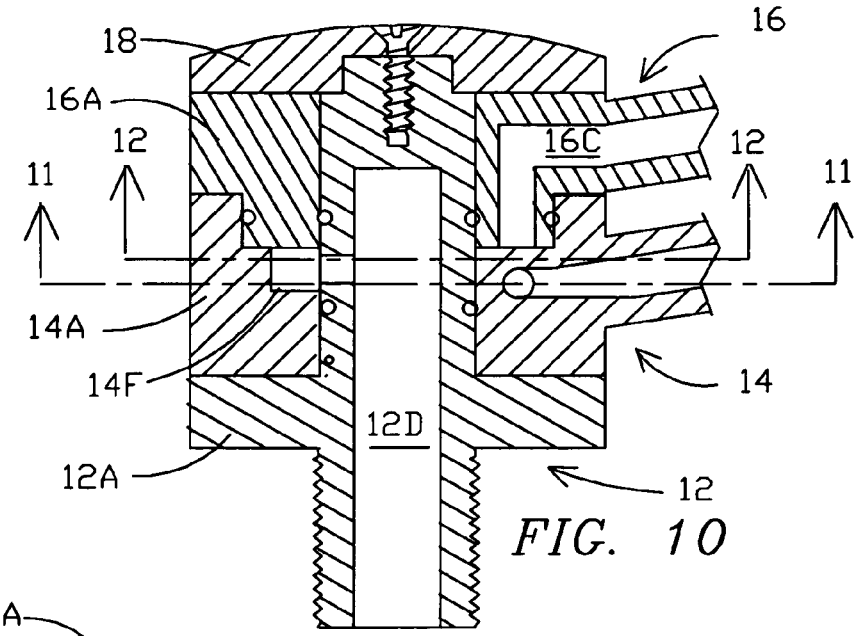

FIG. 10, replicating FIG. 9, is shown to indicate the location of two axis of cross-section 11-11 and 12-12 in horizontal planes.

Figure 11:
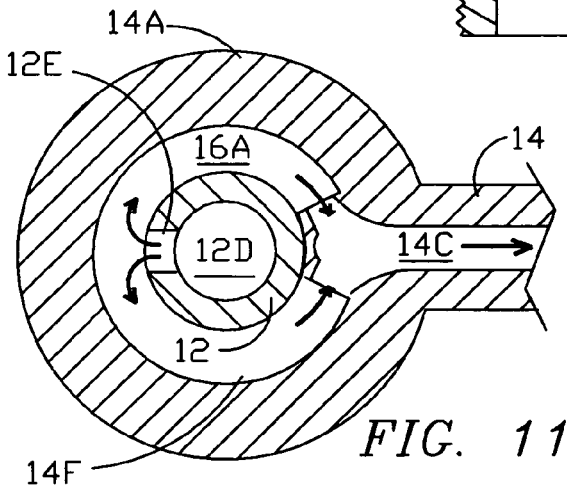
FIG. 11 is a cross-section taken in a horizontal plane through axis 11-11 of the assembled components of FIG. 10.

FIG. 11 is a cross-section of the water spout assembly in the primary embodiment of the invention taken in a horizontal plane through axis 11-11 of FIG. 10. Water flow is indicated by arrows from the central passageway 12D through aperture 12E of support sleeve 12, thence past both sides of support sleeve 12 into two branches of passageway 14C in lower spout 14, causing water to flow from spout 14 regardless of its orientation about the support sleeve 12.

Figure 12:
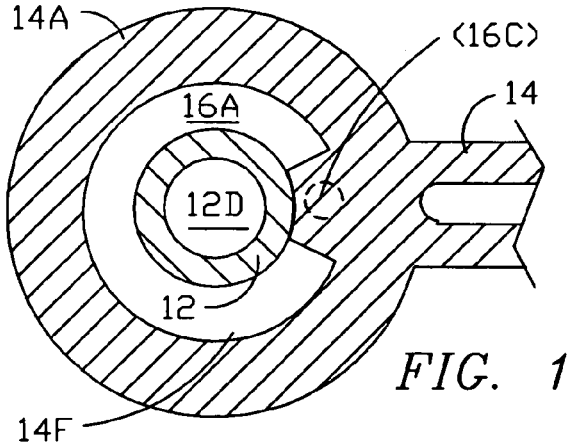
FIG. 12 is a cross-section taken in a horizontal plane through axis 12-12 of the assembled components of FIG. 10.

FIG. 12 is a cross-section of the water spout assembly taken in a horizontal plane through axis 12-12 of FIG. 10. Shown in broken lines is the location of the bottom end of the passageway (16C of upper spout 16) which is blocked off by the upper surface of a "plateau" region formed in hub portion 14A, shown interfacing the right hand side of support sleeve 12.

Figure 13:
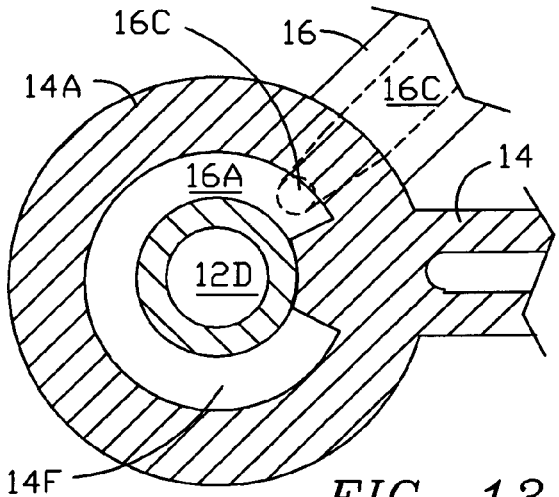
FIG. 13 is a cross-section as in FIG. 12 but with the upper spout rotated out of alignment with the lower spout.

FIG. 13 is a cross-section as in FIG. 12 but with the upper spout 16 now visible, having been rotated clockwise out of alignment with the lower spout 14. In this location, the lower end of its passageway 16C is no longer blocked and receives water from cavity region 16A so that water flows from both spouts 14 and 16 whenever they are non-aligned by a sufficient angle, typically made to be about 20 to 30 degrees by dimensioning the size of the "plateau" blocking segment of hub portion 14A.

Figure 14:
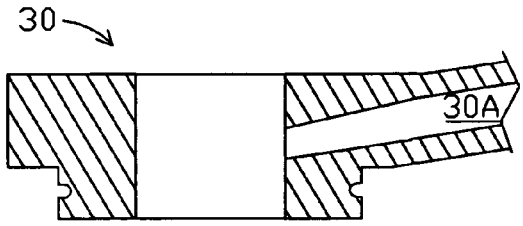
FIGS. 14 and 15 are cross-sections showing an alternative inner configuration of upper and lower hub portions respectively of an alternative embodiment of the water spout assembly of the present invention.
Figure 15:
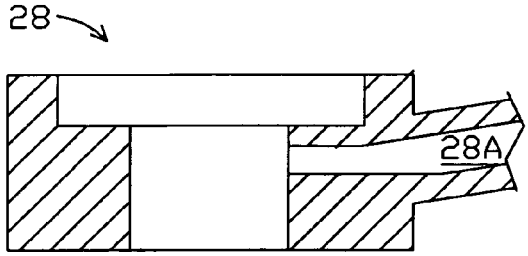

FIGS. 14 and 15 are cross-sections of hub portions 28A and 30A of lower and upper spouts 28 and 30 that are similar externally to previously described spouts 14 and 16; however internally, the passageways 28A and 30A are both configured to simply extend through the hub walls as shown, and the cavity region 14E (FIG. 7) in the lower hub region is eliminated, being replaced with solid metal.

Figure 16:
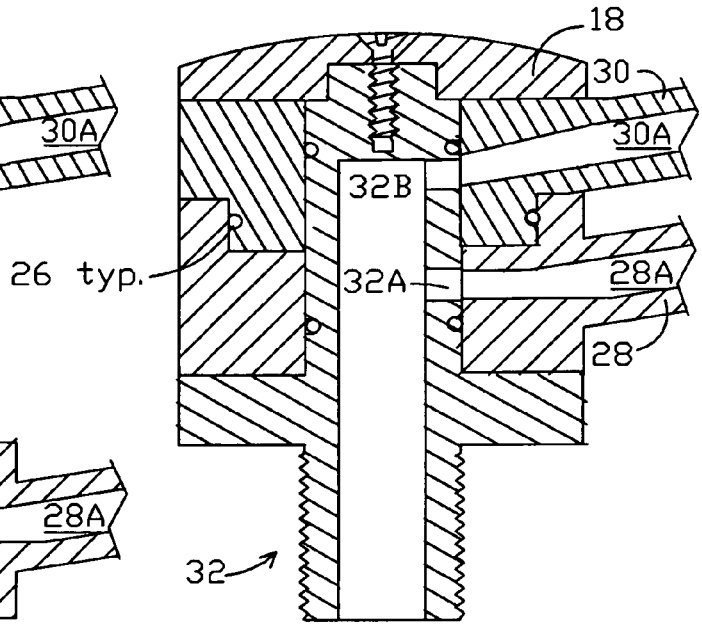
FIG. 16 is a cross-section showing the hubs of FIGS. 14 and 15 assembled with a top cap and an alternatively configured support sleeve in the alternative embodiment.

FIG. 16 is a cross-section showing spouts 28 and 30 of FIGS. 14 and 15 assembled with a top cap 18 and an alternatively configured support sleeve 32 in the alternative embodiment. Support sleeve 32, externally similar to previously described support sleeve 12 (FIG. 8) but with wall aperture 12E eliminated, is configured with two wall apertures 32A and 32B, located to align with passageways 28A and 30A as shown. In this configuration, water flows from both spouts regardless of their angular rotation, even when they are aligned together.

Figure 17:
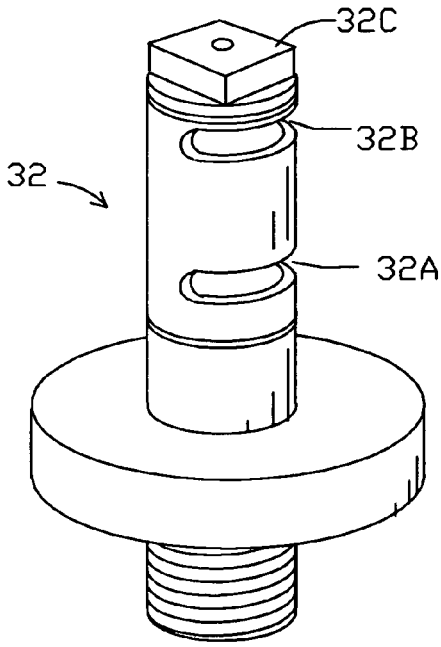
FIG. 17 is a three-dimensional view of the support sleeve configuration shown in FIG. 16 showing two water apertures.
Figure 18:
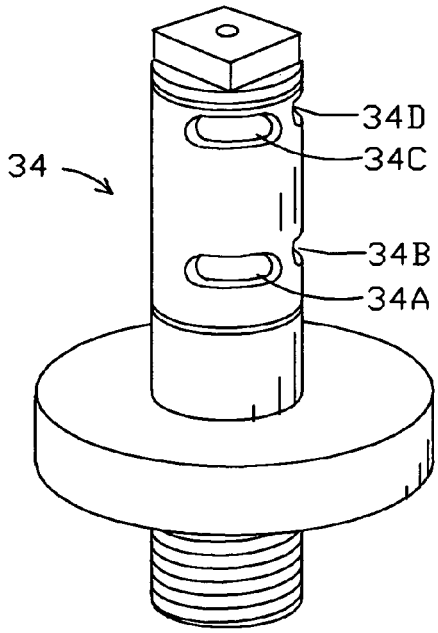
FIG. 18 is a three-dimensional view of a support sleeve as in FIG. 17 in a modified four-aperture configuration.

FIG. 17 is a three-dimensional view of the support sleeve 32 as shown in FIG. 16, showing two horizontally elongated water apertures 32A and 32B configured in the wall of support sleeve 32 as shown. The apertures each extend around the support sleeve 32 sufficiently to allow about 180 degrees of swivel range for each spout. At the upper end of sleeve 32 the square shape of portion 32C is seen: this is the same as square portion 12F (FIG. 8) for holding top cap 18 against rotation, FIG. 18 is a three-dimensional view of a support sleeve 34 which is an alternative version of support sleeve 32 (FIG. 17) wherein the two apertures 32A, 32B of FIG. 17 are replaced by four apertures 34A-D arranged in side-by-side pairs as shown, in effect adding a flow barrier at the center of the full length single apertures (32A,32B; FIG. 17). This flow barrier acts to shut off the water flow from either spout whenever the spout is rotated to the center location. This arrangement avoids splashing of water flowing on the center divider between two sink compartments (12A and 12B, FIG. 1), and also enables the user to select either the upper or the lower spout for single spout use by rotating it away from its central location while keeping the other spout centered.

Figure 19:
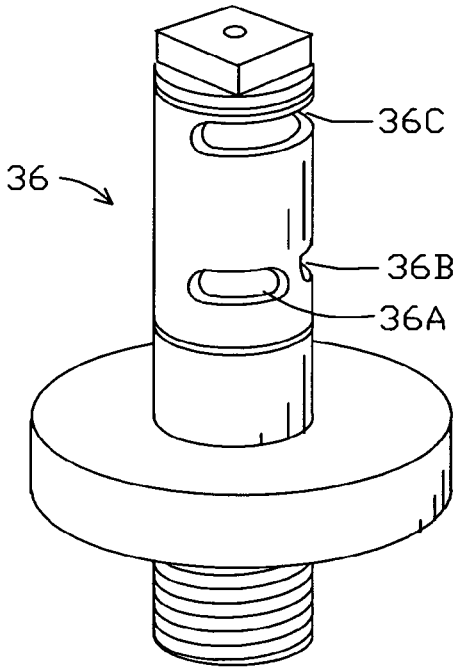
FIGS. 19 and 20 are three-dimensional views of three-aperture versions of the support sleeves shown in FIGS. 17 and 18.
Figure 20:
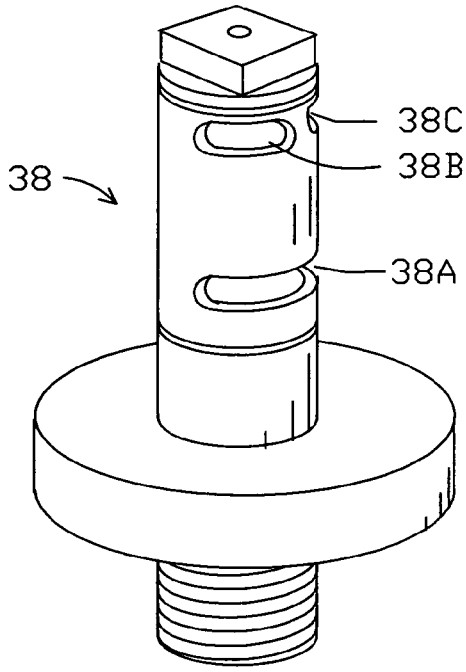

There are two further versions of the secondary embodiment available as design options by configuring different aperture patterns in the support sleeve for the upper and lower spouts. FIG. 19 shows sleeve 36 configured with dual apertures 36A and 36B flanking the central flow barrier to provide the central blockage for the lower spout, and a full length single aperture 36C for the upper spout so that it will not have the central blockage. Conversely, FIG. 20 shows sleeve 38 configured with a full length aperture 38A associated with the lower spout, and dual apertures 38B and 38C associated with the upper spout.

The principle of the invention, i.e. dual swivel spouts, could be practiced with other variations in the embodiments shown as a matter of design choice, e.g. to trade off refinements for lower cost.

There are known alternatives to the square plug-and-socket arrangement shown for removably securing the top cap in place.

It is desirable for the top cap 18 to be firmly secured to the support sleeve and yet made easily removable so that the two spouts can be disassembled from the support sleeve for maintenance purposes, e.g. seal replacement, without disconnecting the water supply or removing the support sleeve. However such convenient removability of the top cap is not essential to the practice of the invention: at the sacrifice of convenience and serviceability, the top cap 18 could be made integral with the support sleeve and the mounting flange (12A, FIG. 8) could be made as a separate part that threads onto the support sleeve from the bottom. Such structure would require the water supply to be disconnected and the water spout assembly to be removed from its installation for any internal maintenance repairs such as seal replacement.

The stepped interface between the two hub portions of the spouts is believed to facilitate and enhance water sealing with the O-ring at cylindrical vertical interface surfaces; however, the step could be eliminated and an alternative approach to sealing implemented e.g. at the interface of two flat horizontal surfaces.

As an alternative to the two simple spouts shown, one or both spouts may be modified to have a swivel extension at the outlet end to increase the range of possible outlet locations.

As an alternative to utilizing faucet handles that are separate from the spout assembly, the principle of dual spouts in accordance with the present invention could be combined in an assembly together with one or more faucet handles or other water flow/shutoff controls connected to one or more (e.g. hot and cold) water sources.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A swivel water spout assembly for providing two separate flows of water simultaneously at variably separated locations, comprising:

a hollow tubular support sleeve having a closed upper end and an open lower end connected to a source of pressurized water;

a lower spout configured at a proximal end region with a hub surrounding said support sleeve and engaged therewith in a manner to swivel thereabout within a predetermined swivel range, and configured with an internal water passageway extending from the proximal end region to a downward-facing outlet at a distal end region;

an upper spout having a proximal region configured with a hub surrounding said support sleeve, disposed above the hub of said lower spout, and engaged with said support sleeve in a manner to swivel thereabout within a predetermined upper spout swivel range, said upper spout, having a distal end region extending further from said support sleeve than the distal end region of said lower spout, being configured with an internal water passageway extending from the proximal end region to a downward-facing outlet at the distal end region;

said support sleeve being configured with at least one aperture made and arranged to conduct water flow into the water passageway of at least one of said spouts; and said support sleeve and said spouts being configured in a manner to block flow of water from at least a predetermined one of said spouts whenever the predetermined spout is rotationally located in a predetermined portion of the swivel range.

2. The swivel water spout assembly as defined in claim 1 wherein said support sleeve and said spouts are configured in a manner to:

allow water flow from said lower spout regardless of location of said lower spout throughout the swivel range thereof; and prevent flow of water from said upper spout whenever said upper spout is located parallel to said lower spout.

3. The swivel water spout assembly as defined in claim 1 wherein said support sleeve and said spouts are configured in a manner to:

allow water flow from said upper spout regardless of location of said upper spout throughout the swivel range thereof;

prevent water flow from said lower spout whenever said lower spout is located in a predetermined central portion of the predetermined swivel range thereof; and allow water flow from said lower spout whenever said lower spout is not located in the predetermined central portion of the predetermined swivel range thereof.

4. The swivel water spout assembly as defined in claim 1 wherein said support sleeve and said spouts are configured in a manner to:

allow water flow from said lower spout regardless of location of said lower spout throughout the swivel range thereof;

prevent water flow from said upper spout whenever said upper spout is located in a predetermined central portion of the predetermined swivel range thereof; and allow water flow from said upper spout whenever said upper spout is not located in the predetermined central portion of the predetermined swivel range thereof.

5. The swivel water spout assembly as defined in claim 1 wherein said support sleeve and said spouts are configured in a manner to prevent water flow from said lower spout whenever said lower spout is located in a predetermined central portion of the predetermined swivel range thereof;

allow water flow from said lower spout whenever said lower spout is not located in the predetermined central portion of the predetermined swivel range thereof;

prevent water flow from said upper spout whenever said upper spout is located in a predetermined central portion of the predetermined swivel range thereof; and allow water flow from said upper spout whenever said upper spout is not located in the predetermined central portion of the predetermined swivel range thereof.

* * * * *